United States Patent [19]

Monagan

[11] 4,032,879

[45] June 28, 1977

[54] CIRCUIT-PROTECTING FUSE HAVING ARC-EXTINGUISHING MEANS

[75] Inventor: Elmer J. Monagan, Jamestown, N.Y.

[73] Assignee: Teledyne, Inc., Los Angeles, Calif.

[22] Filed: Nov. 18, 1975

[21] Appl. No.: 632,951

[52] U.S. Cl. ..... 337/278; 337/162; 337/281

[51] Int. Cl.[2] ..... H01H 85/38

[58] Field of Search ..... 337/278, 279, 273, 280, 337/281, 282, 161, 162, 163, 164, 165, 166, 158

[56] References Cited

UNITED STATES PATENTS

| | | | |
|---|---|---|---|
| 2,892,061 | 6/1959 | Kozacka | 337/158 |
| 3,244,839 | 4/1966 | Albright | 337/278 |
| 3,275,771 | 9/1966 | Salzer | 337/281 |
| 3,418,614 | 12/1968 | Krueger | 337/162 |
| 3,601,737 | 8/1971 | Baird et al. | 337/273 |
| 3,721,935 | 3/1973 | Kozacka | 337/164 |

*Primary Examiner*—Harold Broome

*Attorney, Agent, or Firm*—Shoemaker and Mattare, Ltd.

[57] ABSTRACT

A circuit-protecting fuse comprises an insulating housing having electrically conductive connectors on opposite ends thereof to connect the fuse in an electrical circuit and at least one fusible link in the housing connected in electrically conductive relationship at opposite ends thereof with the connectors. The fusible link has at least one area of limited cross-section defining a heat-generating section and a member of a material which produces arc quenching gas when heated to a predetermined temperature positioned on the heat-generating section, whereby when an overload condition of predetermined magnitude occurs in a circuit in which the fuse is connected, the heat-generating section melts and vaporizes, and the heat thus produced generates an amount of deionizing gas from the member to extinguish any arc which forms at the vaporized section. Seal means seals the fuse to prevent escape therefrom of flames and ionized gas the the like produced as a result of the overload condition.

19 Claims, 19 Drawing Figures

CIRCUIT-PROTECTING FUSE HAVING ARC-EXTINGUISHING MEANS

BACKGROUND OF THE INVENTION

This invention relates to circuit-protecting fuses, and more particularly, to circuit-protecting fuses of the so-called secondary voltage type, wherein the fuse is intended for use in circuits carrying voltages of up to about 600 volts. Fuses designed for use in this voltage range, and those with which the present invention is concerned, are sealed such as to prevent escape therefrom of flames or ionized gases and the like.

There are many different classifications of fuses for use in the aforesaid secondary voltage range, and typically the fuses are designed to operate at up to 250 volts a-c or up to 600 volts a-c, over a span of 6 current-carrying ratings, as for example, from 1 to 30 amperes, from 31 to 60 amperes, from 61 to 100 amperes, from 101 to 200 amperes, from 201 to 400 amperes, and from 401 to 600 amperes. The fuses within each of these ampere ratings have different size casings or housings than in the other ratings, and the fuses in the respective ratings must meet several different design criteria. Some of the design standards which must be met in order for the fuses to obtain UL approval are peak let-through current (Ip), or in other words, maximum instantaneous current through the fuse during the clearing time and up to the time of melting, or time elapsing from the beginning of an overcurrent condition to the final circuit interruption, and the total energy available as a result of current flow, expressed as $I^2t$ and designated as Clearing $I^2t$ or total $I^2t$. There are many other design parameters, as set forth in Underwriters' Laboratories, Inc. Bulletin, UL 198.4 of May 30, 1973. However, the above-noted parameters or standards are the major conditions imposed on obtaining UL approval. The above-noted bulletin, UL 198.4, gives the maximum clearing times, peak let-through current and Clearing $I^2t$ for a Class R fuse at the various ampere ratings from 0 up to 600 amperes. As noted in the said bulletin, Class R fuses are of the nonrenewable cartridge type and have an interrupting rating of 200,000 rms symmetrical amperes. The maximum clearing time for a Class R fuse at 200% rating ranges from 2 minutes to 12 minutes for the various ampere ratings from 0 to 600, and the maximum acceptable peak let-through current (Ip) and total $I^2t$ at a short circuit current of 200,000 amperes, ranges from 14,000 amperes and 50,000 units, respectively, up to 100,000 amperes and 12 million units, respectively, at a cartridge size rated for 600 amperes.

Thus, as can be seen, large amounts of energy are involved.

Electrical fuses act as a safety valve in the event of a sustained overload or fault condition or short circuit current in an electrical circuit, and the fuse is designed to open or clear the excessive current safely and without damage to equipment or circuit components or personnel. However, as noted previously, unlike a safety valve, the built-up energy must be contained within the fuse and rupture or venting of the fuse during clearing is to be avoided, such that flames or ionized gases and the like do not escape therefrom and thus create other potentially dangerous situations.

One of the most difficult problems to be overcome in designing a fuse meeting the above conditions is the fact that at the high energy levels encountered, when a fault condition occurs and the fusible portion of the fuse melts and vaporizes, there is a tendency for the electrical energy to form an arc and jump across the vaporized section, thus failing to interrupt the fault condition current, and consequently resulting in damage to other circuit components or to expensive equipment or to personnel and the like.

Various attempts have been made in the prior art to solve this problem, and such attempts have ranged from the provision of fusible links made of silver encased or embedded in silica sand, to fuses having copper or copper alloy fusible links and provided with as many as 200 separate current-conducting paths or arcing paths, whereby the strength of the current flow through each arcing path is proportionately reduced to prevent arcing occurring at overload conditions. The silver fuses, although very effective due to the abrupt melting point of silver and the fact that vaporized silver is not an electrical conductor, are relatively expensive, and thus are suitable for use only in very critical applications where cost is not of especial concern. The copper and copper alloy fuses, on the other hand, which include a large number of current paths or arcing points, are also expensive and difficult to manufacture, due to the complicated fabrication techniques of producing the fusible links, and also some such fuses are relatively fragile and difficult to handle during assembly. Both of the above-described tupes of fuses have the fusible links thereof embedded in a body of silica sand, and when a fault condition occurs, such that the fusible link melts and vaporizes, the temperature produced by melting and vaporizing of the silver link thereby actually fuses or melts an adjacent portion of the sand, forming a type of glass known as fulgurite, which acts as an insulating barrier between the adjacent portions of the fusible link on opposite sides of the vaporized section, to prevent arcing thereacross. However, notwithstanding the large number of arcing paths provided in prior art copper or copper alloy fuses, it has been observed that prolonged arcing does occur such that the surrounding silica sand actually forms a hollow shell rather than a solid plug of fused glass-like material to block the arc.

A common fuse design of the type with which the present invention is concerned is a so-called dual element fuse, in which a time delay section is provided between spaced short circuit sections, whereby under prolonged low overload conditions the time delay section is designed to gradually build up heat and eventually interrupt the circuit, and under severe overload conditions or short circuit conditions, the fusible links at opposite sides of the time delay section are designed to melt and vaporize to interrupt the circuit. In this type fuse, fiber washers or partitions are provided in the barrel of the fuse between the short circuit sections and the time delay section to prevent or restrict entry of the silica sand filler into the time delay section where it might interfere with proper operation of the time delay section. However, analysis of prior art fuses tested under severe overload conditions indicates that the pressure developed when the fusible link or links vaporize actually blows the fiber washers into the time delay section and permits displacement of the silica sand from the short circuit sections, thus reducing the efficiency of the silica sand in forming a barrier to the arc generated at the short circuit section. Consequently, the fuse fails to perform according to the design considerations necessary for that fuse.

All of the above problems are effectively and economically solved by the present invention. For example, in accordance with the present invention both one-time fuses employing zinc links or links of copper or copper bearing metals, and dual-element fuses, are provided with means at the short circuit sections made of a material which generates an arc quenching gas when heated to a predetermined degree, whereby the heat generated as a result of a fault condition causes production of a deionizing gas from the means to thus extinguish any arc which may form at the vaporized section of the fusible link. Additionally, because of the use of the material with its arc-extinguishing characteristics, a significantly smaller number of current conducting paths or short circuit paths are required than are required in prior art devices, with the result that upon the occurrence of a fault condition, faster heating of the arcing points and faster clearing time for the fuse is obtained than with prior art fuses. For example, a fuse at a particular rating may require only 4 short circuit paths in accordance with the present invention, whereas a prior art fuse of the same rating may require up to 200 short circuit paths. Additionally, in accordance with the present invention, an adhesive cement is provided at the peripheries of the fiber washers, separating the short circuit sections from the time delay section, whereby upon a fault condition occurring, the washers are not deformed or deflected into the time delay section, and the silica sand filler is thus maintained in the short circuit sections, and any ionized gases or deionizing gases produced from the arc quenching means are also maintained in the short circuit sections, whereby any arcs tending to form are quickly extinguished. The adhesive cement is also provided at the end caps and blades of the fuses to effect a secure and pressure tight seal, to thus prevent escape of ionized gases or flames and the like from the fuse under overload conditions. Further, in accordance with one form of the invention, the fiber washers are replaced with washers made of an arc quenching material, whereby the tendency of any arc to form in the time delay section when the time delay section interrupts the circuit under conditions of prolonged overload is prevented by the release of deionizing gases from the arc quenching material.

A preferred arc quenching material to extinguish the formation of arcs in the fuses according to the present invention is an acetal resin plastic material, because of its exceptional non-tracking and non-carbonizing characteristics, and also because it has good electrical and insulating properties not affected by changes in environment. Also, the cement is preferably an inorganic silicate adhesive.

OBJECTS OF THE INVENTION

It is an object of this invention to provide a circuit-interrupting fuse which requires less material and is less expensive to manufacture than prior art fuses, and which meets and exceeds the performance of prior art fuses of comparable ratings.

Another object of the invention is to provide a circuit interrupting fuse which has substantially fewer arcing paths and which is less complex and more rugged and reliable in operation than prior art fuses of comparable rating.

A further object of the invention is to provide a dual element circuit-interrupting fuse for use in the secondary voltage range, wherein the fuse is effectively sealed to prevent escape therefrom of flames or ionized gases and the like.

A still further object of the invention is to provide a sealed circuit-interrupting fuse which includes a fusible link having a short circuit section which melts and vaporizes under circuit overload conditions, and wherein an arc quenching material is on the short circuit section to extinguish any arc tending to form across the vaporized section.

Yet another object of the invention is to provide a circuit-interrupting fuse of the dual element type, which includes a time delay section and a short circuit section on each side of the time delay section, with arc quenching means on the short circuit sections to produce arc quenching gas, and wherein means is provided to prevent escape of arc quenching gas from the short circuit sections under severe overload conditions.

Another object of the invention is to provide a circuit-interrupting fuse that has a reduced number of arcing points as compared to a prior art fuse of comparable rating, and consequently has a faster heating and melting time at low level and medium level fault conditions and thus provides superior protection against the fault conditions.

A further object is to provide barriers of arc quenching material in the arcing path of the fuse, which tend to prevent expansion of the arcing path.

DETAILED DESCRIPTION OF THE INVENTION

Figure 1:
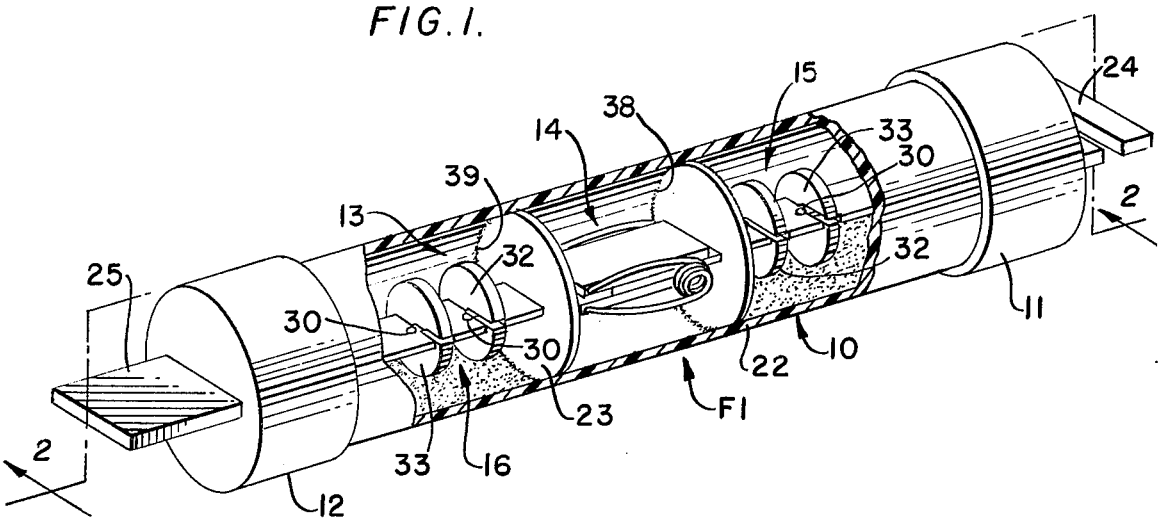
FIG. 1 is a perspective view, with portions thereof broken away, of a first modification of a first type of fuse according to the present invention.
Figure 2:
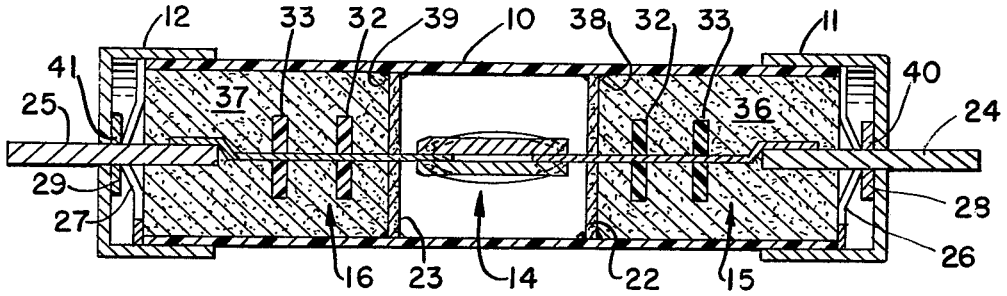
FIG. 2 is a vertical, sectional view on reduced scale of the fuse of FIG. 1 and is taken along line 2—2 in FIG. 1.
Figure 3:
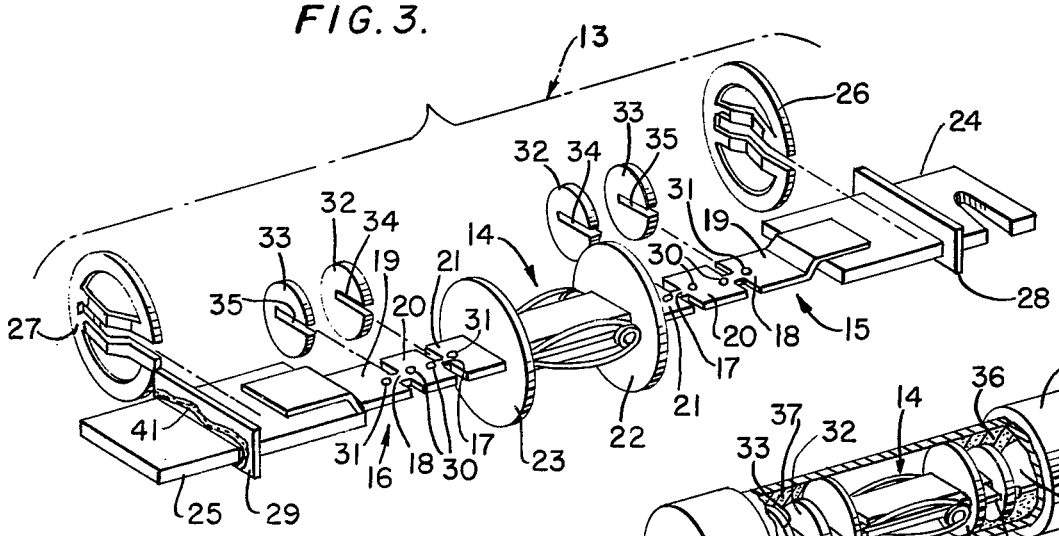
FIG. 3 is an exploded, perspective view of the end connectors, short circuit sections, time delay section, arc-extinguishing members and retaining washers of the fuse of FIG. 1.

In the drawings, wherein like reference numerals indicate like parts throughout the several views, a first form of fuse F1 in accordance with the invention is illustrated in FIGS. 1–3, and comprises an elongate, tubular case or barrel 10 made of a suitable insulating material, such as fiber, ceramic, melamine or Bakelite and the like, as is well known in the art, and having its opposite ends closed by a pair of end caps 11 and 12 formed of a suitable metallic material. Disposed within the barrel or case 10 is an elongate, current-conducting and circuit-interrupting member 13, having a time delay section 14 substantially in the center thereof, as more fully described in U.S. Pat. No. 3,046,374 to J. B. Wright, issued July 24, 1962, and a pair of short circuit sections or fusible links 15 and 16 on opposite sides of the time delay section 14. The short circuit sections include areas 17 and 18 of limited cross-section, to thus provide heat-generating areas under overload conditions. Each of the short circuit sections or fusible links 15 and 16 also includes heat-radiating fins 19, 20 and 21 on opposite sides of the heat-generating sections or areas 17 and 18. A pair of spaced apart washers 22 and 23 of suitable insulating material, such as fiber or the like, are secured on the current-conducting member or structure 13 and separate or partition the time delay section 14 from the short circuit sections or fusible links 15 and 16.

The outer ends of the short circuit sections 15 and 16 are secured, respectively, to end connectors or blades 24 and 25, which serve to electrically connect the fuse in a circuit. A pair of spring washers or biasing clips 26 and 27 are engaged between the opposite outer ends of barrel or case 10 and a pair of abutments 28 and 29 fixed on the end connectors or blades 25 and 26, in a manner more fully described in U.S. Pat. No. 3,041,428 to A. Sommers, issued June 26, 1962.

As seen best in FIG. 3, the short circuit sections or portions of limited cross-section are further reduced in size and divided into a plurality of current-carrying paths or fusible sections by means of the provision of a pair of holes 30 and 31 in the heat-radiating fins adjacent opposite ends of each of the limited cross-section portions 17 and 18 of the fusible links. Thus, the current flow through the fuse is limited to areas of relatively small cross-section, and accordingly, when an overload condition of predetermined magnitude occurs, heat buildup in these limited cross-section areas is rapid, with the result that the circuit is interrupted in a minimum amount of time, to thus protect equipment, circuit components and personnel.

In addition, and constituting a major feature of the invention, arc quenching means, preferably comprised of acetal resin plastic members 32 and 33 in the shape of discs and the like, and having slots 34 and 35 therein, are mounted on the sections 17 and 18 of limited cross-section. The acetal resin plastic members are made from a material sold under the tradename Delrin, manufactured by E. I. du Pont Nemours Co., and they possess excellent non-tracking qualities and high dielectric properties and produce a deionizing gas when subjected to the temperature at which the short circuit sections 17 and 18 melt and vaporize. Accordingly, the discs have the function of acting as a barrier to the expansion of current flowing through the arcing point and inhibiting the formation of ionized gas due to vaporization of the reduced sections 17 and 18, and thus the formation of electrical arcs across the vaporized sections is substantially minimized. Accordingly, when the sections 17 and 18 melt and vaporize, the circuit is interrupted more quickly than in some prior art fuses. Additionally, the Delrin discs 32 and 33 provide a certain amount of insulation to the areas 17 and 18 of limited cross-section, such that heat buildup therein is not dissipated into the silica sand filler 36 and 37 surrounding the fusible links 15 and 16, thus speeding the melting time of the fusible links, thereby improving the performance of the fuse.

In order to provide a stronger fuse structure and to obtain a more effective seal between the time delay section and short circuit sections of the fuse and between the interior and exterior of the fuse, an inorganic silicate adhesive cement 38 and 39 is applied to the peripheries of the washers or partitions 22 and 23, respectively, bonding the peripheral portions of the washers to the inner surface of the case 10, and the inorganic silicate adhesive cement is also applied at 40 and 41 to the area between abutments 28 and 29, respectively, and that portion of the end caps 11 and 12 through which the blades 24 and 25 extend.

Fuse F1 of FIGS. 1–3 is designed for application in circuits involving or requiring 200 amps at up to 600 volts. In use, the fuse F1 is inserted into the circuit in a conventional manner, and under sustained or prolonged overload conditions greater than about 110% of rated load, the solder holding the spring biased contacts of the time delay section together melts, allowing the spring biased sections to spring open, interrupting the circuit. The fuse is designed such that it will operate or maintain the circuit intact indefinitely at 110% of rated load. Under conditions of severe overload, as when a short circuit occurs, the fusible sections 17 and 18 are heated and melt and vaporize almost instantaneously, thereby interrupting the circuit. In conventional fuses, which utilize copper or copper alloys and the like in the construction of the fuse, the amount of copper required to be used in the fuse to enable it to conduct adequate current is such that the amount of metal vaporized under a short circuit condition creates a large amount of volatilized or vaporized metal, which is conductive, and accordingly, an arc forms across the vaporized section, and may thereby continue to conduct current through the fuse. In the present invention, the Delrin discs 32 and 33 positioned on the fusible sections 17 and 18 are heated by the arc, and thus generate a deionizing gas, which quickly extinguishes the arc, thus preventing conduction of current through the fuse after the sections 17 and 18 have vaporized. Additionally, the heat generated during vaporization of the sections 17 and 18 melts or fuses the surrounding portion of the silica sand 36 and 37, forming an insulating plug of glass-like material, which effectively blocks the transmission of current across the vaporized section.

Figure 4:
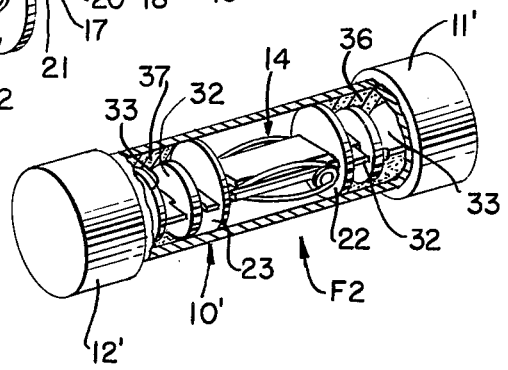
FIG. 4 is a perspective view on a reduced scale of a Ferrule type fuse in which the end caps thereof form the end connectors.

A Ferrule type fuse F2 embodying the present invention, is shown in FIG. 4, and includes a case 10′ having the two short circuit sections and time delay section therein separated by partitions 22 and 23, and having Delrin arc-extinguishing members 32 and 33 on the fusible sections thereof. End caps 11′ and 12′ are provided for connection in an electrical circuit in a conventional manner.

Figure 5:
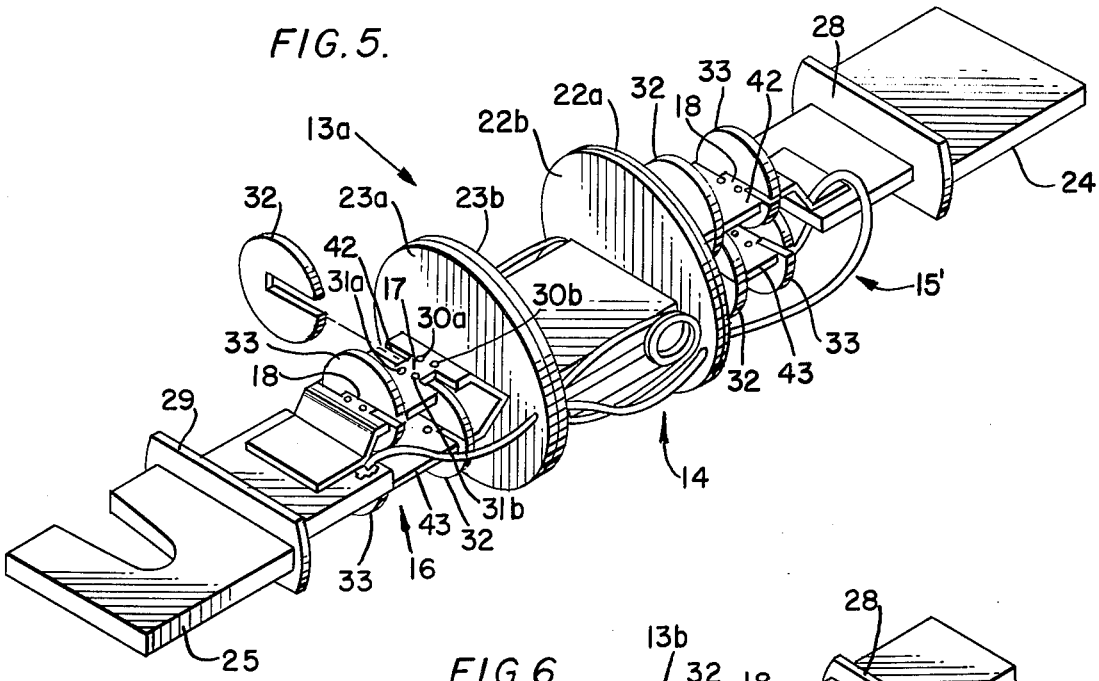
FIG. 5 is a view similar to FIG. 3 of a third modification of the invention, and showing a third type of fuse.

In FIG. 5, a modified current-conducting portion 13*a* of a fuse in accordance with the invention includes a time delay section 14, as in the FIG. 1 embodiment, and modified short circuit sections 15′ and 16′, each of which includes a pair of fusible links 42 and 43 connected in parallel with one another, and each of the fusible links 42 and 43 includes a series-connected pair of short circuit sections or fusible sections 17 and 18 of limited cross-section, as in the FIG. 1 embodiment. Also in this form of the invention, a pair of holes 30*a* and 30*b* and 31*a* and 31*b* are provided in the fin sections of each of the links 42 and 43 adjacent opposite ends of the fusible sections or short circuit sections 17 and 18, to thus define a plurality of parallel short circuit paths or current-conducting paths at each fusible section, whereby the magnitude of current flow through each section is proportionately reduced, and the tendency of an arc to form under overload conditions is accordingly reduced. Further in this form of the invention, a pair of washers or partitions 22*a* and 22*b* and 23*a* and 23*b* are provided at opposite sides of the time delay section 14 for greater strength and resistance to deflection or deformation of the partitions under severe overload conditions. Arc-extinguishing discs or members 32 and 33 are provided on the short circuit sections 17 and 18 to extinguish arcs, as in the previous form of the invention. The fuse in FIG. 5 has a 600 amp, 600 volt rating.

Figure 6:
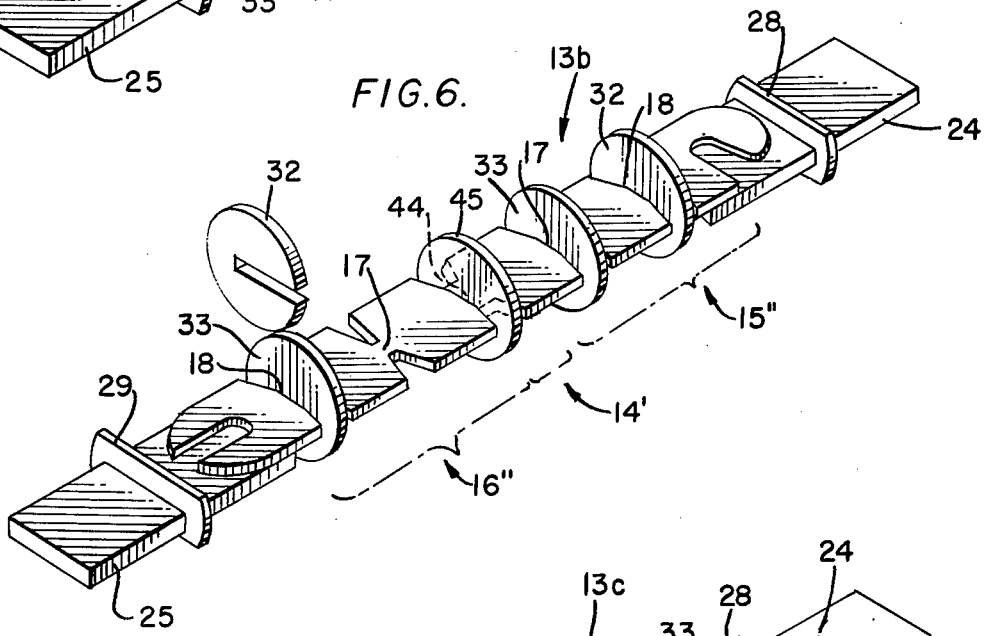
FIG. 6 is a view similar to FIG. 5 of a fourth modification of the invention, showing a so-called "one-time" fuse.

In FIG. 6, yet another form of current-conducting portion 13*b* of a fuse in accordance with the invention is illustrated, and comprises a modified time delay or normal overload section 14′ and a pair of short circuit or fusible link sections 15″ and 16″ on opposite sides of the normal overload section 14′. The current-conducting member 13*b* is for use in so-called one time fuses, and the particular fuse illustrated in FIG. 6 has a 200 amp, 600 volt rating. The short circuit portions 17 and 18 in each of the short circuit sections 15″ and 16″ are of limited cross-section, as in the previously described embodiments, and the normal overload section 14′, rather than including the spring biased members as in the previously described embodiment, includes a portion 44 of limited cross-section, but of greater cross-section than the portions 17 and 18. Arc-extinguishing discs 32 and 33 are provided on the short circuit sections 17 and 18, and an arc-extinguishing disc 45 is also provided on the time delay or normal overload section 14′.

Figure 7:
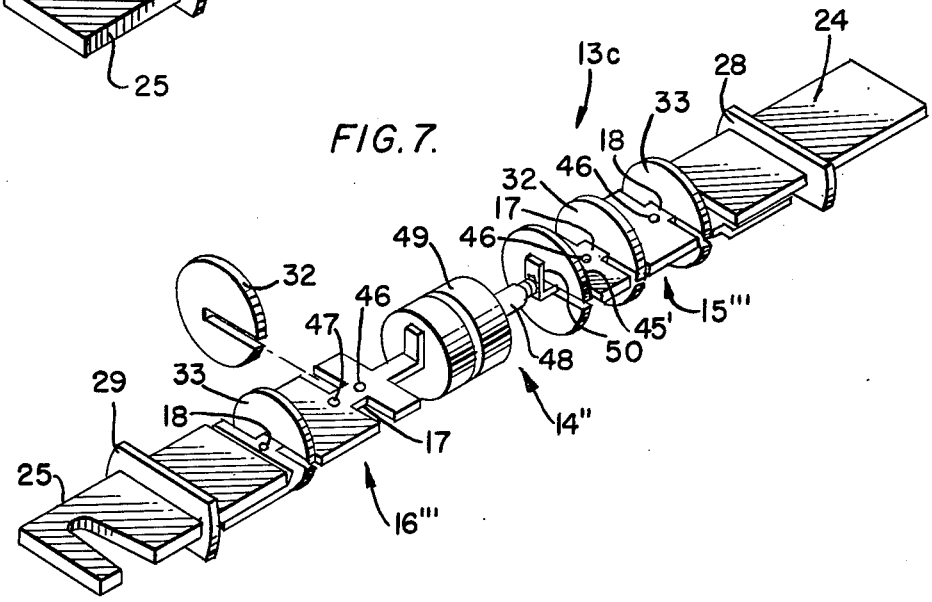
FIG. 7 is a view similar to FIG. 6 of a fifth modification of the invention, showing a fifth type of fuse.

In FIG. 7, a still further modified current-conducting portion 13*c* includes a time delay section 14″ and short circuit sections or fusible links 15‴ and 16‴. Each of the short circuit sections 15‴ and 16‴ includes a pair of limited cross-section areas 17 and 18 on which are positioned arc-extinguishing discs or members 32 and 33, and at the opposite ends of which are provided holes 46 and 47. The time delay section 14″ includes a spring biased plunger 48 slidably received in a cylinder 49 and biased inwardly thereof. The plunger 48 is soldered to an upstanding post 50 at an adjacent end of one of the short circuit sections or fusible links 15‴, and when a normal overload condition occurs of a predetermined magnitude, the solder melts, releasing the plunger 48, which is retracted into the cylinder 49, thereby interrupting the circuit. A disc 45′ of arc-extinguishing meaterial is positioned adjacent post 50, to extinguish any arc which may tend to form as the solder melts and plunger 48 pulls away from post 50 under low level fault conditions. As previously described, when a severe overload condition occurs, such as a short circuit or the like, the short circuit sections or fusible portions 17 and 18 melt and vaporize, thereby interrupting the circuit. The holes 46 and 47 further reduce the limited cross-section available for current flow, whereby heat is generated more rapidly in the fusible sections to interrupt the circuit in an exceptionally short amount of time. Additionally, the arc-extinguishing discs 32 and 33 generate deionizing gas to extinguish any arc which may form at the vaporized sections.

Figure 8:
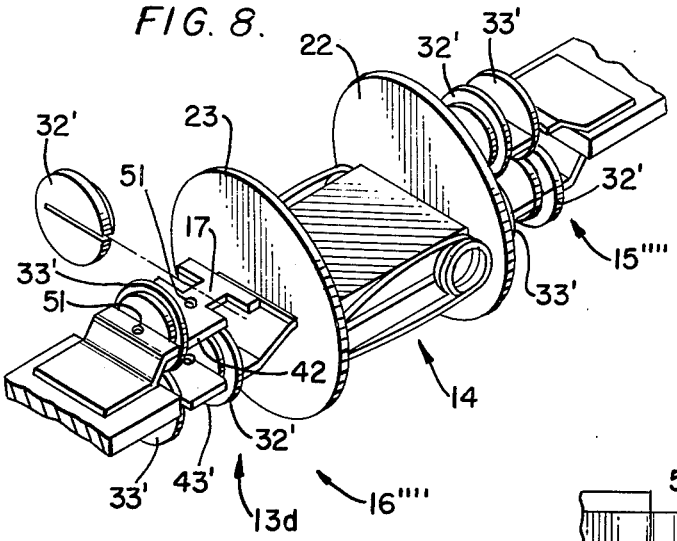
FIG. 8 is an enlarged, perspective, fragmentary, exploded view of a sixth modification of the invention and is a preferred form of the type of fuse shown in FIG. 5.
Figure 9:
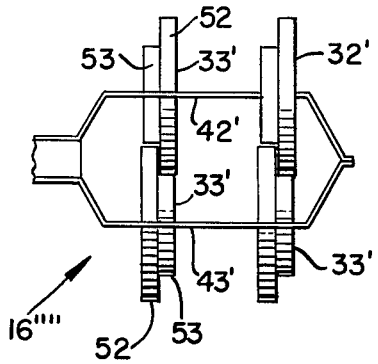
FIG. 9 is a fragmentary, enlarged view in elevation of one of the short circuit sections of the fuse of FIG. 8.
Figure 10:
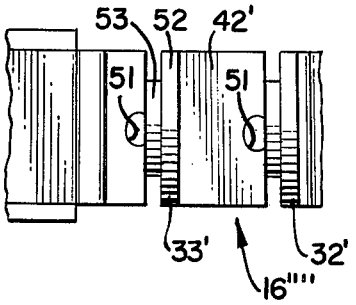
FIG. 10 is an enlarged, fragmentary, plan view of one of the short circuit sections of the fuse of FIG. 8.

In FIG. 8, a still further modified current-conducting portion 13*d* is illustrated, and this form of the invention is substantially the same as that illustrated in FIG. 5, except that in each of the short circuit sections or fusible link sections 15⁗ and 16⁗ only one hole 51 is provided at one end of the fusible sections 17 and 18 in each of the parallel fusible links 42′ and 43′. Also, in this form of the invention, and as seen best in FIGS. 9 and 10, modified arc-extinguishing discs 32′ and 33′ are provided on the sections 17 and 18 of limited cross-section, and the modified discs 32′ and 33′ include portions 52 and 53 of different diameter, whereby when the arc-extinguishing members are applied to the fusible sections 17 and 18 on adjacent fusible links 42′ and 43′, the arc-extinguishing member on one link is reversed relative to the arc-extinguishing member on the other link, such that the different diameter portions nest within one another. Also, the thickness of the arc-extinguishing members in FIGS. 8–10 is such as to extend completely over and cover the fusible portions or sections 17 and 18. The holes 51 in this form of the invention are the largest possible which will enable the fuse to operate indefinitely at 110% of rated load without interrupting the circuit. The fuse illustrated in FIGS. 8–10 is designed for use in circuits carrying from 201 to 600 amperes at up to 600 volts.

Figure 11:
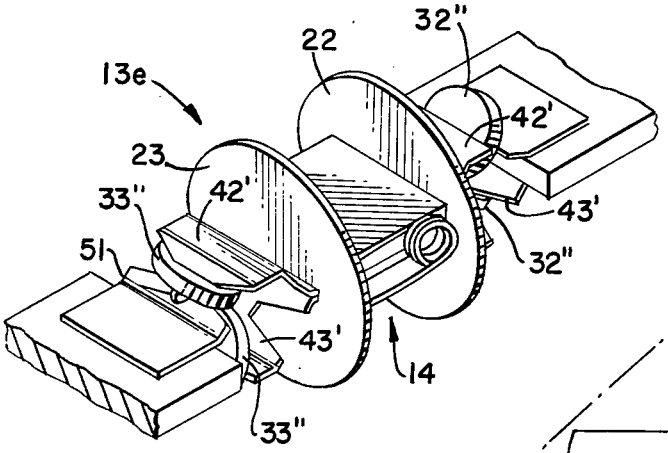
FIG. 11 is a seventh modification of the invention and is a preferred form of the fuse of FIG. 8.
Figure 12:
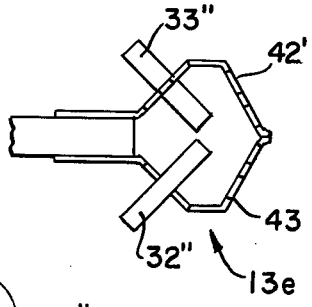
FIG. 12 and FIG. 13 are elevational and plan views, respectively, similar to FIGS. 9 and 10, of the fuse of FIG. 11.
Figure 13:
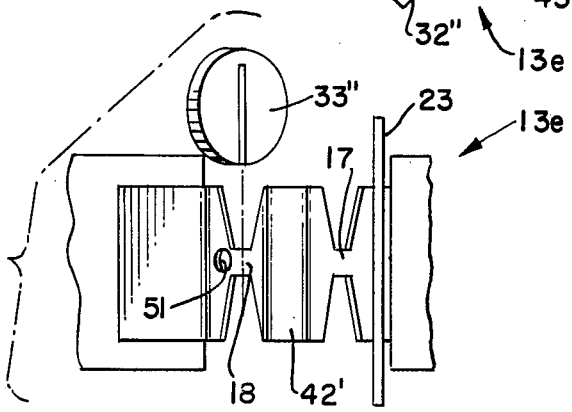

In FIGS. 11–13, a still further form of current-conducting portion 13*e* for use in a fuse according to the invention is illustrated, and is substantially identical to the form of the invention illustrated in FIGS. 5 and 8, except that rather than having a hole 51 at one end of each of the fusible sections 17 and 18 in each of the fusible links 42′ and 43′, a hole 51 is provided at one end of only the fusible section 18 nearest the blade, and the arc-extinguishing discs 32″ and 33″ are of a substantially constant thickness and are of a thickness sufficient to cover the entire width of the fusible section 18. Also, as can be seen in FIGS. 11–13, the fusible sections 17 and 18 are provided on the inclined portions of the fusible links, and the stepped configuration of the arc-extinguishing members as in FIGS. 8–10 is not necessary.

In all forms of the invention previously described, which utilize separating washers or partitions between the time delay section and fusible links or short circuit sections, the partitions or washers may be made of any suitable insulating material, such as fiber or the like, or they may be made of an arc-extinguishing material, such as Delrin, whereby any arc which tends to form in the time delay section will be extinguished.

Figure 14:
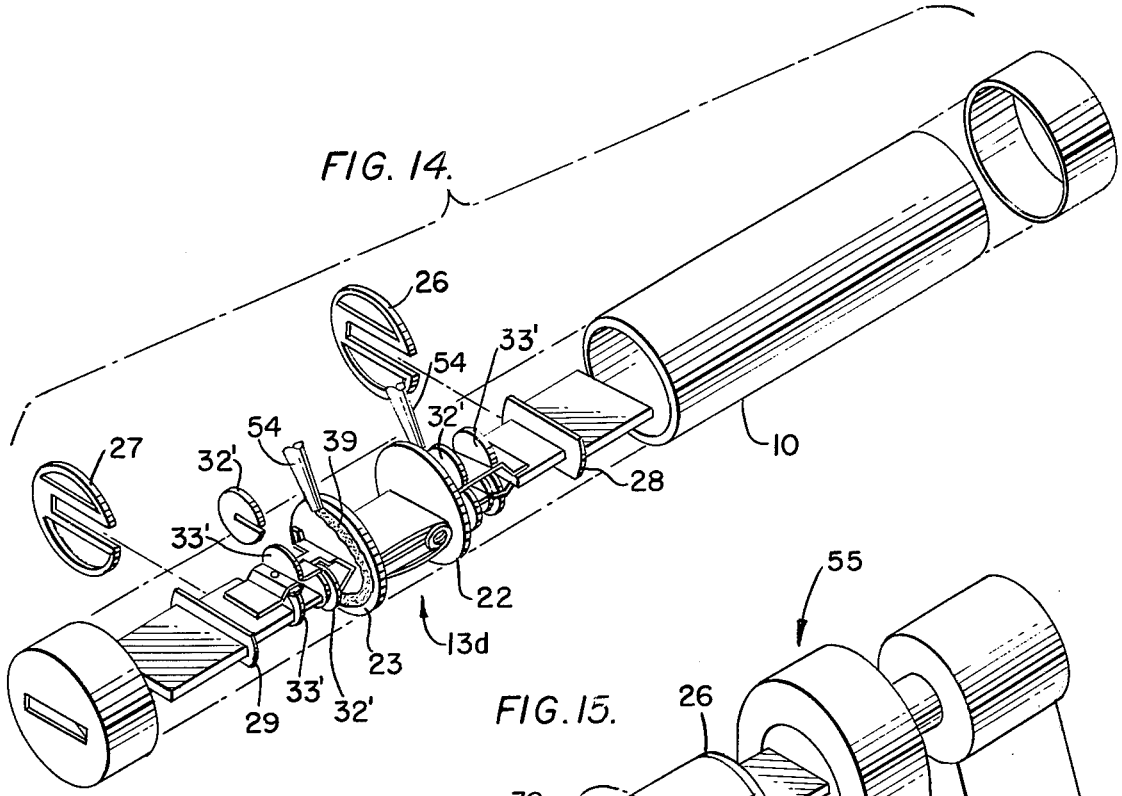
FIG. 14 is an exploded, perspective view of the fuse of FIG. 8, showing one manner in which the parts are assembled and the manner in which the adhesive may be applied to the washers dividing or separating the short circuit sections from the time delay section of the fuse.
Figure 15:
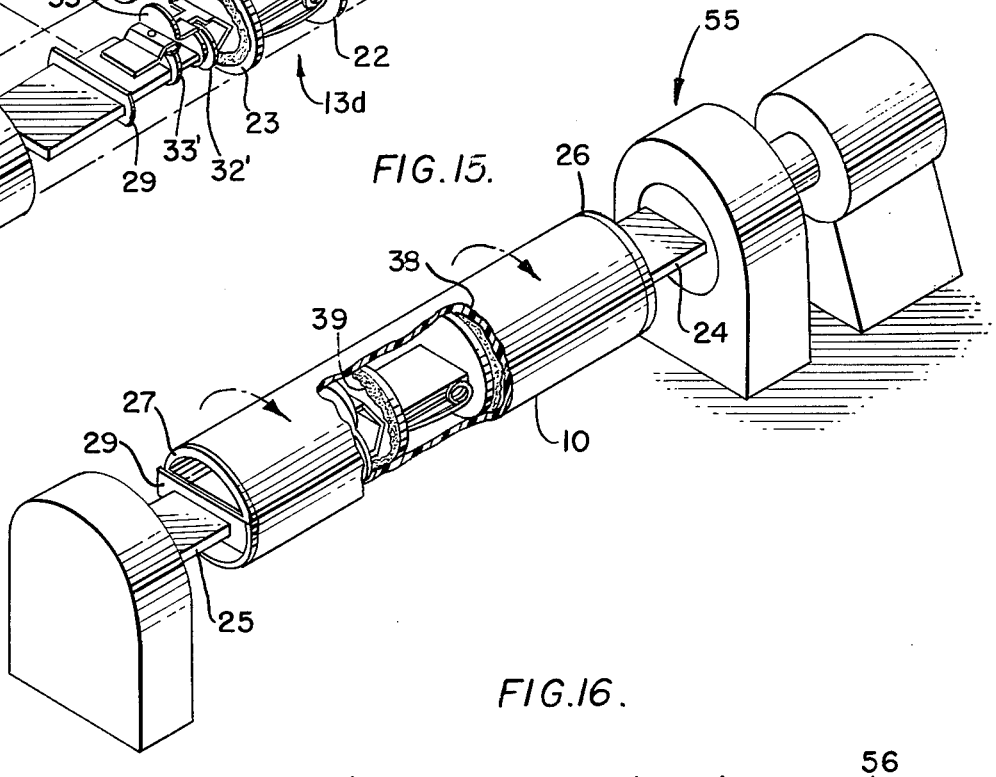
FIG. 15 is a somewhat schematic, perspective view illustrating one way in which the adhesive applied to the separators or partitions in FIG. 14 is caused to flow to and seal the area between the peripheries of the partitions and the inner surface of the fuse barrel.
Figure 16:
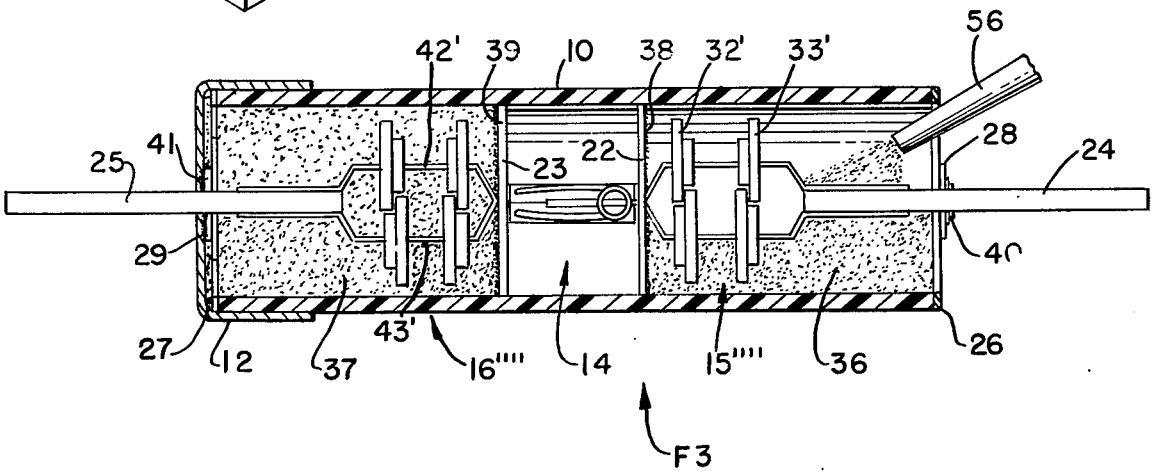
FIG. 16 is an enlarged view in section showing somewhat schematically one manner in which the silica sand filler may be introduced into the short circuit sections of the barrel.

One method of assembling a fuse in accordance with the invention is illustrated somewhat schematically in FIGS. 14–16, and in assembling the fuse the partitions or washers 22 and 23 are positioned on the current-conducting member 13*a* at opposite sides of the time delay section, and the arc-extinguishing members are attached to the fusible sections 17 and 18 on the fusible links 42′ and 43′. Suitable adhesive materials, such as the inorganic silicate adhesive cement 38 and 39 is then applied to the outer faces of partitions 22 and 23 by means of suitable glue applicators 54, and the current-conducting member 13*d*, with the partitions and arc-extinguishing members assembled thereto, is then positioned in the case 10 of the fuse. The retaining washers 26 and 27 are then positioned between the ends of the case 10 and the abutments 28 and 29 to retain the current-conducting portion 13*d* under slight tension and to maintain its position within the case 10. The thus assembled fuse is then mounted in a suitable apparatus 55 and caused to rotate as indicated by the arrows in FIG. 15, whereby the adhesive 38 and 39 applied to the faces of partitions 22 and 23 flows outwardly to effect a seal and bond between the peripheries of the partitions 22 and 23 and the inner surface of the case 10. The fuse is then removed from the apparatus 55 and the silica sand filler 36 and 37 is then introduced into the short circuit sections of the fuse by means of a suitable applicator 56 and the adhesive 40 and 41 is then applied either to the outer surface of abutments 28 and 29 or to the inner surface of caps 11 and 12 adjacent the blade receptive slots therethrough, and the caps 11 and 12 are then inserted onto the opposite ends of the case 10 to form a completed, assembled fuse F3.

Figure 17:
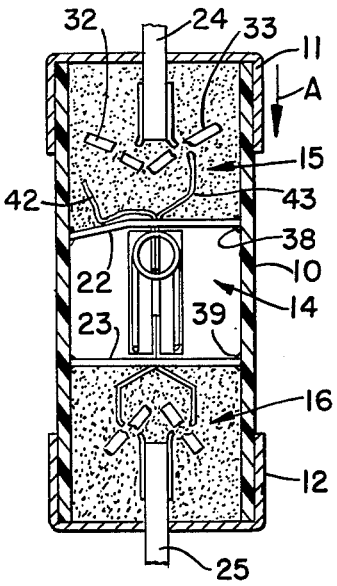
FIG. 17 is a somewhat schematic view in section of a fuse according to the present invention which has been subjected to a severe overload condition, and wherein the short circuit sections have vaporized to interrupt the current.
Figure 19:
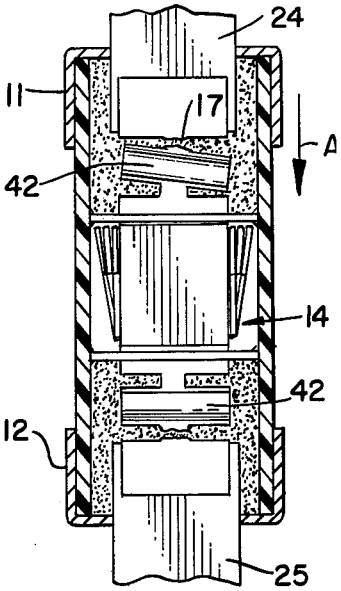
FIG. 19 is a view taken at 90 degrees to the view of FIG. 17.

In FIGS. 17 and 19 a fuse substantially similar to that illustrated in FIGS. 11–13 is shown in section, and the fuse is illustrated as it would typically appear after being subjected to a severe overload condition, such as a short circuit or the like. The direction of current flow in the particular fuse shown would be in the direction indicated by the arrow A, and the fusible links 42 and 43 at the upper end of the fuse as seen in FIGS. 17 and 19 are deformed more severely than the links in the lower portion of the fuse. In this fuse, the Delrin discs have partially vaporized. Further, it will be observed that the partitions or discs 22 and 23 separating the time delay section from the short circuit sections have remained substantially intact and in position, due at least in part to the adhesive 38 and 39 securing their peripheries to the inner surface of the case 10, and accordingly, the sand filler in the short circuit sections has remained in those sections and has not been displaced into the time delay section.

Figure 18:
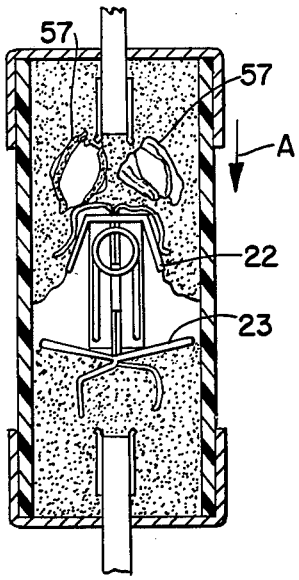
FIG. 18 is a view similar to FIG. 17 of a prior art fuse illustrating the manner in which the partitions or washers separating the short circuit sections from the time delay section have failed or deformed inwardly, permitting the silica sand filler to enter into the time delay section.

On the other hand, as seen in FIG. 18, a prior art fuse construction has been subjected to a severe overload condition, and as seen in the upper short circuit portion or section of the fuse in FIG. 18, lumps or shells 57 of glass-like material have formed as a result of arcing through the silica sand filler, and the washers or partitions separating the short circuit sections from the time delay section have collapsed inwardly into the time delay section, permitting some of the sand filler to be displaced from the short circuit sections, whereby the effectiveness of the sand in quenching arcs formed at the vaporized sections of the fusible links is substantially reduced.

Delrin may be used as a substitute for the fiber partitions or washers or it may be used as a supplement thereto. For example, in FIG. 8, one washer (nearest the time delay section) could be made of Delrin.

While Delrin has been described as a preferred arc quenching material, other materials could be used, and the arc quenching members could have any desired, suitable shape, and need not have a disc shape, as particularly described.

With a fuse constructed in accordance with the present invention, a substantial savings in material and cost can be realized.

Moreover, in the embodiments of fuses described herein, those having current limiting holes in the fusible links are designed to carry 110% of rated load indefinitely.

Also, in FIGS. 11–13, the fuse illustrated, with only one hole at the outermost area of limited cross-section in each fusible link, is designed for use in a circuit for 400 or 600 amperes, at up to 250 volts.

Additionally, in one fuse construction made by applicant, a performance nearly 2½ times as great as that of a similar prior art fuse was obtained.

Still further, applicant has successfully interrupted DC circuits up to 300 volts.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A circuit-protecting fuse, comprising: an insulating housing having a longitudinal axis and having electrically conductive connector means on opposite ends thereof to connect the fuse in an electrical circuit; at least one short circuit section in said housing, connected in electrically conductive relationship at opposite ends thereof with the connector means, said short circuit section having at least one area defining a heat-generating fusible link; a non-conducting arc blocking member of a material which produces a deionizing gas when heated to a predetermined temperature positioned at said fusible link in close proximity thereto and covering substantially only the fusible link to block laterally of the longitudinal axis of the housing any arc which tends to form under an overload condition of predetermined magnitude in a circuit in which said fuse is connected, whereby the fusible link melts and vaporizes, and the heat thus produced causes the arc blocking member to generate an amount of deionizing gas to extinguish any arc which forms at the vaporized section; and closure means sealed on the ends of the housing to contain the deionizing gas whereby any arc which forms is quickly extinguished.

2. A fuse as in claim 1, wherein the insulating housing comprises an elongate, cylindrical, open-ended case; and closure means comprises end caps secured on opposite ends of the case closing the open ends thereof.

3. A fuse as in claim 2, wherein the end caps are sealed to the ends of the case with an adhesive cement.

4. A fuse as in claim 3, wherein there are at least two fusible links connected in series, defining at least two short circuit sections.

5. A fuse as in claim 1, wherein there are at least two fusible links connected in series, defining at least two short circuit sections, and a time delay section is connected in series between the short circuit sections, said time delay section including a portion which melts when the fuse is subjected to a sustained overload condition of predetermined magnitude, to thus interrupt the circuit.

6. A fuse as in claim 5, wherein an insulating partition is mounted in the case between the short circuit sections and the time delay section, maintaining them separate.

7. A fuse as in claim 6, wherein the short circuit sections of the fuse are filled with silica sand filler surrounding the fusible links therein, whereby when the fuse is subjected to a severe overload, such as a short circuit, and at least one of the areas of reduced cross-section melts and vaporizes, the sand surrounding the melted portion blocks current flow across the melted portion.

8. A fuse as in claim 6, wherein the insulating partitions are adhesively secured in the case to prevent their displacement under severe overload conditions.

9. A fuse as in claim 1, wherein there are two fusible links, each having only two arcing paths or areas of limited cross-section.

10. A fuse as in claim 7, wherein the fusible links each have only two arcing paths or areas of limited cross-section; and an acetal resin plastic arc-quenching member is on each area of limited cross-section.

11. A fuse as in claim 10, wherein there are only two fusible links.

12. A fuse as in claim 1, wherein there are at least two fusible links, each having two areas of limited cross-section and each has a hole therethrough at the ends of the areas of limited cross-section, thus subdividing the areas into a plurality of limited cross-section arcing paths.

13. A fuse as in claim 1, wherein the arc blocking member comprises acetal resin plastic and has a width as great as the length of the area of limited cross-section and substantially completely covers said area.

14. A fuse as in claim 13, wherein the acetal resin plastic member is substantially disc-shaped and includes two portions of different diameter.

15. A fuse as in claim 14, wherein there are at least four fusible links, with pairs of the fusible links connected in parallel with one another on opposite sides of the time delay section, each fusible link having two areas of limited cross-section, and an acetal resin plastic member positioned on each limited cross-section area, adjacent plastic members on adjacent areas of limited cross-section of the fusible links of a pair being inverted, whereby the different diameter portions thereof interfit with one another.

16. A fuse as in claim 8, wherein the adhesive cement is an inorganic silicate.

17. A fuse as in claim 1, wherein the arc blocking member has a slot therein extending from about the center thereof through one edge, and the area of limited cross-section is received in said slot.

18. A fuse as in claim 5, wherein the time delay section includes a spring biased element soldered in a first position against the bias of the spring in which the time delay section conducts current, and movable to a second, circuit-interrupting position under an overload condition of predetermined magnitude to melt the solder.

19. A fuse as in claim 18, wherein the spring biased element comprises an axially movable plunger soldered to an upstanding post, and an arc quenching member on the fusible link adjacent the post to quench any arc which may form upon retraction of the plunger away from the post.

* * * * *